US010661185B2

(12) United States Patent
Kroon et al.

(10) Patent No.: US 10,661,185 B2
(45) Date of Patent: May 26, 2020

(54) AMUSEMENT DEVICE

(71) Applicant: Cobra Beheer B.V., Neede (NL)

(72) Inventors: Albert Louisito Phillipus Kroon, Neede (NL); Robert Arnoud Hoftijzer, Aalten (NL)

(73) Assignee: Cobra Beheer B.V., Neede (NL)

( * ) Notice: Subject to any disclaimer, the term of this patent is extended or adjusted under 35 U.S.C. 154(b) by 0 days.

(21) Appl. No.: 16/356,262

(22) Filed: Mar. 18, 2019

(65) Prior Publication Data

US 2019/0291012 A1 Sep. 26, 2019

(30) Foreign Application Priority Data

Mar. 20, 2018 (NL) ..... 2020624

(51) Int. Cl.
*A63G 9/16* (2006.01)
*A63G 9/08* (2006.01)
*A63G 27/02* (2006.01)

(52) U.S. Cl.
CPC ..... *A63G 9/16* (2013.01); *A63G 9/08* (2013.01); *A63G 27/02* (2013.01)

(58) Field of Classification Search
CPC . A63G 9/16; A63G 9/08; A63G 27/02; A63G 7/00; A63B 31/00
USPC ..... 472/119, 46, 30, 44, 45; 104/75; 272/28 R
See application file for complete search history.

(56) References Cited

U.S. PATENT DOCUMENTS

| | | | | |
|---|---|---|---|---|
| 2,229,966 A | | 1/1941 | Eyerly | |
| 3,972,527 A | * | 8/1976 | Bacon | A63G 9/16 472/16 |
| 4,032,138 A | | 6/1977 | Willis | |
| 4,807,869 A | | 2/1989 | Knijpstra | |
| 5,314,383 A | * | 5/1994 | Fabbri | A63G 9/08 472/3 |
| 5,688,178 A | * | 11/1997 | Emrie | A63G 1/38 438/654 |
| 5,941,777 A | * | 8/1999 | Moser | A63G 27/02 472/44 |
| 5,947,828 A | | 9/1999 | Fabbri | |
| 8,926,440 B2 | | 1/2015 | Jacobi | |
| 2004/0192453 A1 | | 9/2004 | Esparza et al. | |

(Continued)

FOREIGN PATENT DOCUMENTS

| | | |
|---|---|---|
| DE | 8317459 | 11/1983 |
| EP | 2754472 | 7/2014 |

(Continued)

*Primary Examiner* — Michael D Dennis
(74) *Attorney, Agent, or Firm* — N.V. Nederlandsch Octrooibureau; Catherine A. Schultz; Katelyn J. Bernier

(57) ABSTRACT

The current invention relates to an amusement device, in which the amusement device includes a first tower; a first arm, extending between a first end and a second end, which is at its first end rotatably connected to the first tower for allowing rotation over at least 180° and configured to rotate around a swining axis (Sa); a carrier, rotatably connected to the second end of the first arm and rotatable around a carrier rotation axis, and a stability mechanism, connecting the carrier with the first tower, wherein the stability mechanism is configured to maintain the carrier in an upright orientation while the first arm rotates around the swinging axis.

12 Claims, 9 Drawing Sheets

(56) References Cited

U.S. PATENT DOCUMENTS

| | | | | |
|---|---|---|---|---|
| 2012/0071251 | A1* | 3/2012 | Crawford | A63G 27/02<br>472/45 |
| 2013/0123030 | A1 | 5/2013 | Jacobi | |
| 2013/0233198 | A1 | 9/2013 | Roodenburg et al. | |

FOREIGN PATENT DOCUMENTS

| | | | |
|---|---|---|---|
| EP | 2754472 | A | 7/2014 |
| NL | 9002499 | A | 6/1992 |

* cited by examiner

AMUSEMENT DEVICE

FIELD OF THE INVENTION

The present invention relates to an amusement device comprising:

- a first tower;
- a first arm, extending between a first end and a second end, which is at its first end rotatably connected to the first tower for allowing rotation over at least 180°, in particular allowing full rotation, wherein the first arm is configured to rotate around a horizontal swinging axis, defined by the first end of the arm,
- a carrier, rotatably connected to the second end of the first arm and rotatable around a carrier rotation axis.

BACKGROUND ART

Such an amusement device is known from US20040192453A1 that relates to an entertainment apparatus including an enclosure; and a ride placed within the enclosure. The ride includes a looping swing ride including two vertical supports, each including top portions, two parallel swing arm outriggers including first and second ends, the parallel swing arm outriggers journaled in rotatable fashion about a first axis proximate the top portions of the two vertical supports, and a passenger gondola suspended by pendulum arms from the first ends of the parallel swing arm outriggers to rotate about a swing axis. The ride is programmable to start rotation and stop rotation at a plurality of rotational position locations of the parallel swing arm outriggers of the looping swing ride relative to the two vertical supports of the looping swing ride about the first axis, and to start and stop rotation at a plurality of rotational positions of the passenger gondola relative to the parallel swing arm outriggers about the swing axis, in synchronization with one or more theatrical elements. The purpose of US20040192453A1 is to synchronize movements with theatrical elements. Movement of the gondola is not stabilized as perceived by passengers in the gondola. Stopping at a plurality of rotational positions of the passenger gondola is not a form of stabilizing the gondola in a predefined angular position while rotating about the swing axis.

Such an amusement device is also known from U.S. Pat. No. 5,314,383A that relates to a funfair ride having a rocking ship. The ride, of the type mounted on the plane of a transportable carriage comprises a pair of telescopic uprights to which a frame is connected, the frame comprising a shaft and a pair of levers having equal arms, which frame rotates about the axis of the shaft and which bears a ship connected to the levers and in its turn rotating about an axis parallel to the shaft; the height of the uprights, their extension, the length of the arms of the levers and the maximum height of the ship have a size conformation and relationship such as to permit of compacting the ride into transportable dimensions, without disconnecting among themselves the various pieces that compose the ride. The ship can rotate freely about its axis. A brake is present which can prevent, on command, the free rotation of the ship about its axis. This brake on command is not a form of stabilizing the ship in a predefined angular position while rotating around the axis of the shaft.

SUMMARY OF THE INVENTION

The present invention seeks to provide an amusement device with a simple way to stabilize a carrier, as perceived by the passenger, in a predetermined angular position, in particular a horizontal position.

The present invention further seeks to provide an amusement device wherein a problem associated with the amusement device is at least partly solved.

The present invention even further seeks to provide an alternative amusement device.

According to the present invention, an amusement device is provided, in which the amusement device comprises:

- a first tower;
- a first arm, extending between a first end and a second end, which is at its first end rotatably connected to the first tower for allowing rotation of at least 180°, wherein the first arm is configured to rotate around a swinging axis (Sa), defined by the first end of the first arm,
- a carrier, rotatably connected to the second end of the first arm and rotatable around a carrier rotation axis,
- a stability mechanism, connecting the carrier with the first tower, wherein the stability mechanism is configured to maintain the carrier in an upright orientation while the first arm rotates around the swinging axis.

The carrier is connected to the tower through the arm to allow the carrier to rotate around the swinging axis. The carrier is connected to the tower through the stability mechanism. Thus the carrier is connected to the tower through both the stability mechanism and the arm that work in parallel. Therefore, the stationary tower can function as a reference for the carrier and a defined angular position can be imposed to the carrier while rotating around the swing axis.

The arm rotates around a swinging axis, or in other words an axis of rotation. Generally, the swinging axis is horizontal. The swinging axis refers to the swinging motion of the carrier around the swinging axis. It will be clear that the swinging motion of the carrier around the swinging axis may involve free swinging motion or actively powered swinging motion. The arm is also referred to as swinging arm.

The first arm extends between a first end and a second end, and is at its first end rotatably connected to the first tower. In connection with the first tower, it will be clear that any suitable support structure, like a wall, will suffice, as long as the first arm and carrier are supported at such height that the arm and carrier are able to swing.

The stability mechanism works in parallel with the first arm. The stability mechanism extends between the first tower and the carrier seen from the side.

In an embodiment of the amusement device, the stability mechanism comprises a first parallel guide link systems, which connects the carrier with the first tower. The rigid parallel link, or also arm, members of a parallel guide link systems assure a reduced backlash, slop or mechanical clearance between a tower and the carrier. This is highly important for the product life time of the amusement device and for the ride experience of a passenger.

In an embodiment of the amusement device, the stability mechanism comprises first and second parallel guide link systems, wherein at least one of the first and the second parallel guide link systems connect the carrier with the first tower. Providing a first and second parallel guide link systems enables to provide an even more improved stability for the carrier since the first and second parallel guide link systems can complement each other.

In an embodiment of the amusement device, positions of the first and second parallel guide link systems differ when projected in a plane perpendicular to the swinging axis, such that the first and second parallel guide link systems are adapted to alternately stabilize the carrier when the swinging arm rotates around the swinging axis. Arranging the first and second parallel guide link systems in differing positions enables to provide an even more improved stability since the first and second parallel guide link systems can complement each other depending on the angular position of the arm around the swing axis. The first and second parallel guide link systems being in differing positions enables to avoid the scenario that both the first and second parallel guide link systems are in a "dead point" at the same time. The "dead point" refers to the situation that the parallel link members that is the parallel arm member and the swinging arm, and the crankshaft are all in line. In the dead point of a parallel guide link system, the stabilizing effect of the parallel guide link system to the angular position of the carrier is at a minimum.

In an embodiment of the amusement device, wherein each of the first and second parallel guide link systems comprise a crankshaft, and wherein positions of the first and second parallel guide link systems differ in that the respective crankshafts make an angle $\alpha$ of about 90° with each other. Arranging the first and second parallel guide link systems in differing positions in that respective crankshafts make an angle $\alpha$ of about 90° enables to provide an even more improved stability since the first and second parallel guide link systems can complement each other in an optimal way.

In an embodiment, the amusement device further comprises;

a second tower, spaced apart from the first tower;

a second arm, extending between a first end and a second end, which is at its first end rotatably connected to the second tower, wherein the first and second arms are configured to together rotate around the horizontal swinging axis, defined by the first ends of the first and second arms, wherein the carrier is rotatably connected to the second ends of the first and second arms, and rotatable around the carrier rotation axis. The first tower and second tower, spaced apart from the first tower enables to distribute the stabilizing system between the towers.

In an embodiment of the amusement device, the first parallel guide link system connects to the first tower and the second parallel guide link system connects to the second tower. The first parallel guide link system being connected to the first tower and the second parallel guide link system being connected to the second tower provides still a distributed stabilizing system, however is less complex and more robust.

In an embodiment of the amusement device, at least one of the first and second parallel guide link systems comprises a parallel arm member that is freely rotatable around a parallel arm member rotation axis eccentric with respect to the swinging axis, and wherein the parallel arm member is connected to the first or second tower through a rotation mechanism that extends around the swinging axis. The rotation mechanism extending around the swinging axis enables to use the tower as reference member for the parallel guide link system and at the same time allows that the stabilizing mechanism can function over a full 360° rotation of the carrier around the swinging axis because the parallel arm member and the swinging arm and their respective bearings do not interfere. It will be clear that the rotation mechanism extending around the swinging axis includes extending around an imaginary swinging axis. The rotation mechanism is a 360° rotation mechanism. The rotation mechanism may comprise a plain bearing, a sliding contact bearing, a ring bearing, a ball bearing, a slewing bearing, or any other suitable means. The rotation mechanism has a centre of rotation that is offset with respect to the swinging axis. The axis of rotation of the rotation mechanism is parallel with respect to the swinging axis.

The parallel arm member, or also parallel link member, connecting to the rotation mechanism that extends around the swinging axis has the advantage that the relatively low stabilizing forces bear at an outside diameter of a mounting plate while the relative high motion forces to rotate the carrier bear at an inside diameter. Nevertheless, it may be conceivable that the swing arm and parallel arm member interchange and the swing arm connects to the rotation mechanism instead, and the parallel arm member connects to a conventional bearing of the swinging arm.

In an embodiment of the amusement device, the respective crankshafts of the first and second parallel guide link systems are fixedly connected to the carrier. The crankshaft being fixedly connected to the carrier enables to impose an angular position to the carrier referring to the stationary tower.

In an embodiment of the amusement device, wherein the carrier has in use a centre of mass above the carrier rotation axis. This makes the stabilizing system all the more useful.

In an embodiment of the amusement device, the first and second arms are adapted to rotate over 360 degrees around the swinging axis. This full rotation of the first and second arms around the swinging axis is all the more possible because of the link member that is connected to the first or second tower through the rotation mechanism that extends around the swinging axis.

In an embodiment of the amusement device, the carrier rotation axis is adapted to stay parallel to the swinging axis while the first and second arms rotate around the swinging axis.

In an embodiment, the amusement device comprises at least one counterweight, attached to the first arm and/or the second arm.

In an embodiment, the amusement device comprises a horizontal member, oriented along the swinging axis and connecting the first ends of the first and second arms.

In an embodiment of the amusement device, the first and second towers are supported by a transportable unit. The transportable unit can be any suitable type of unit like a trailer or a container.

SHORT DESCRIPTION OF DRAWINGS

The present invention will be discussed in more detail below, with reference to the attached drawings, in which FIG. 1 shows in perspective view an amusement device according to the invention in a first position;

DESCRIPTION OF EMBODIMENTS

Figure 1:
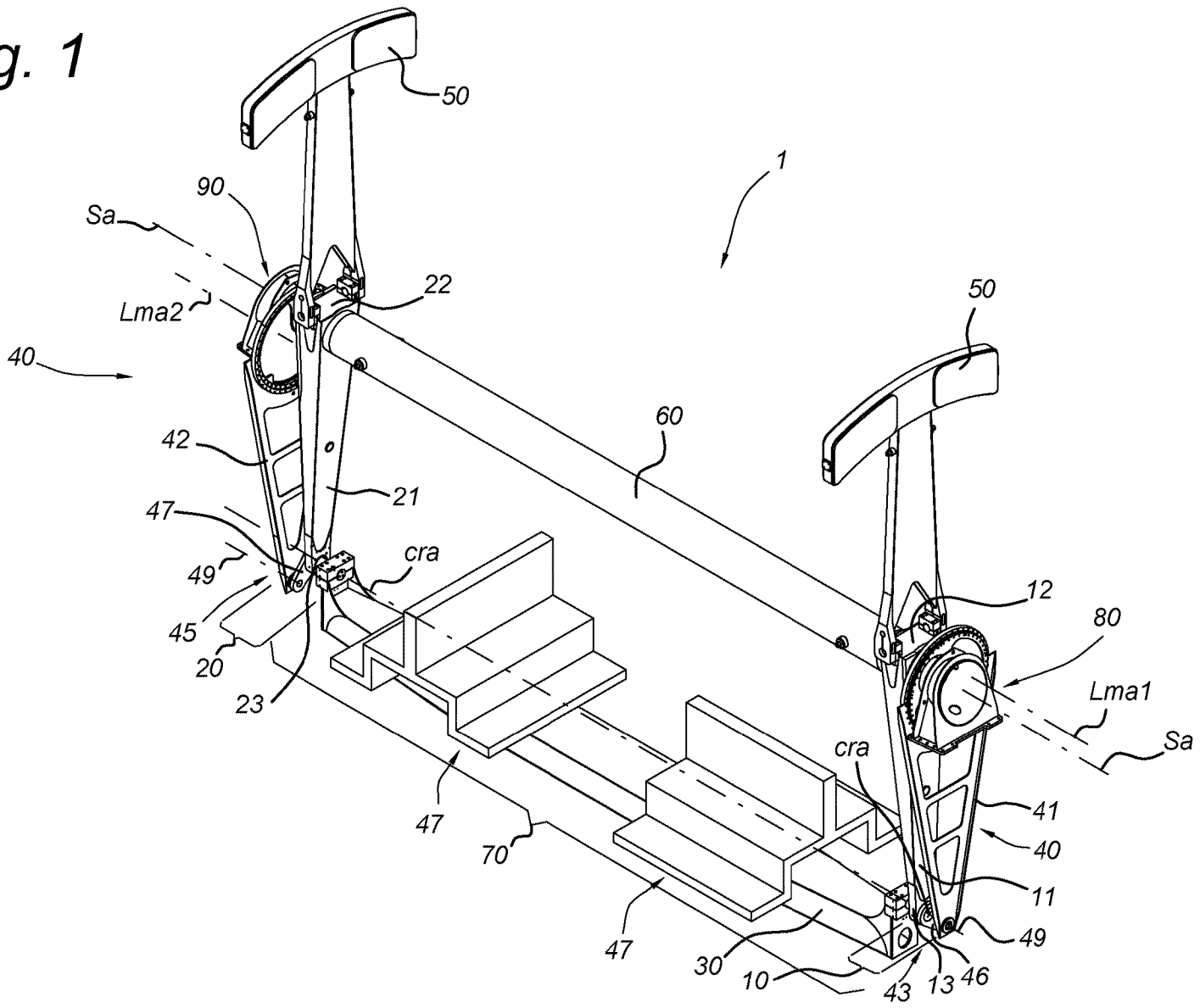

FIG. 1 shows in perspective view an amusement device 1 according to the invention in a first position. The amusement device has a carrier 30 for passengers. The carrier 30 can make a full swing around a swinging axis Sa. The swinging axis Sa extends horizontal. The carrier 30 maintains a defined position while swinging around the swinging axis. In other words, the carrier 30 maintains a predetermined angular position, here a horizontal position as shown, while swinging around the swinging axis Sa. This defined position of the carrier 30 has for its purpose to maintain the passenger a natural upright position. Seating 47 is only shown schematically. Any seating will suffice. It is even possible for passengers to stand.

Figure 2:
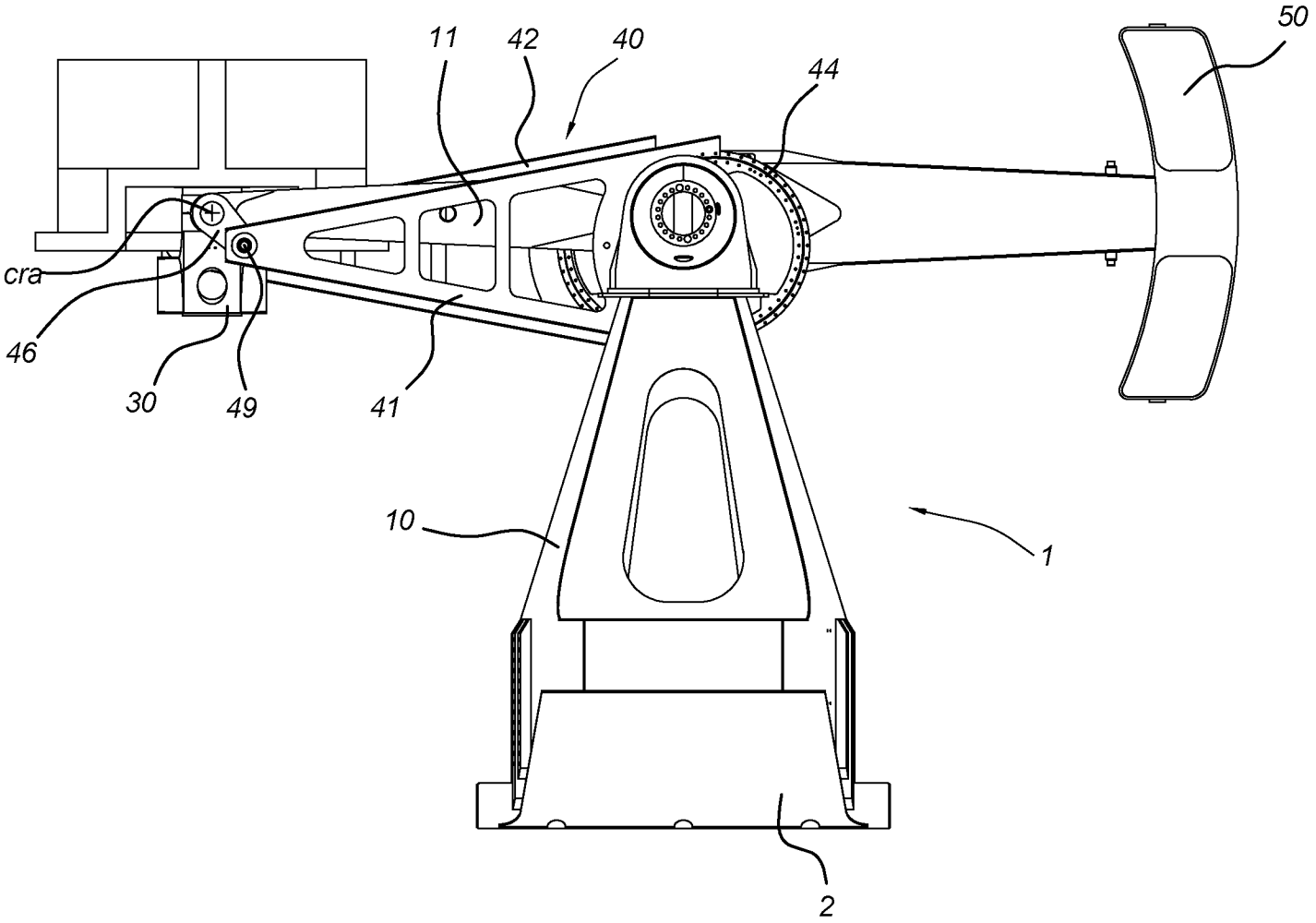
FIG. 2 shows a side view of the amusement device of FIG. 1 in a second position.

The amusement device 1 comprises a first tower 10 as best shown in FIG. 2 and a second tower 20. In FIG. 1 only a top section 80, 90 of the first and second towers 10, 20 is shown. The towers 10, 20 support the swing structure 70. The first and second tower 10, 20 may connect directly to ground. It may also be conceivable that the swing structure 70 is supported by a wall element (not shown). As an option, the first and second towers 10, 20 can be placed on a transportable unit 2 shown in FIG. 2, like a trailer or a container. The first and second tower 10, 20 are spaced apart. The swing structure 70 is arranged between the first and second tower 10, 20. The first and second tower 10, 20 do not extend in swinging space so that the carrier 30 can make a full 360° swing around the swinging axis Sa. In other words the first and second swinging arms 11, 21 are adapted to rotate over 360 degrees around the swinging axis Sa.

In order to maintain the carrier 30 in the defined position while swinging around the swinging axis Sa, the amusement device 1 comprises a stability mechanism 40. The stability mechanism 40 connects to the carrier 30 and to the first tower 10, and here, also the second tower 20. The stability mechanism 40 works in parallel with the support function of the towers 10, 20. Or, to put it differently, the carrier 30 is connected to the first and second tower 10, 20 through both the stability mechanism 40 and the first and second arm 11, 21. The stability mechanism 40 and the first and second arm 11, 21 work in parallel. The stationary first and second tower 10, 20 function as a reference for the carrier 30. The stability mechanism 40 is configured to maintain the carrier 30 in an upright orientation, that is the defined position, while the carrier 30 rotates around the swinging axis Sa. In other words, the stability mechanism 40 imposes a defined angular position to the carrier 30 while rotating around the swing axis Sa. The stability mechanism 40 comprises first and second parallel guide link systems 43, 45. The first and second parallel guide link systems 43, 45 complement each other in stabilizing the carrier 30.

The amusement device 1 comprises a first swinging arm 11 and a second swinging arm 21. The first and second swinging arm 11, 21 extend between respective first ends 12, 22 and second ends 13, 23. The first and second swinging arms 11, 21 are configured to together rotate around the horizontal swinging axis. The swinging axis Sa is defined by the first ends 12, 22 of the swinging arms 11, 21. The amusement device 1 comprises at both sides of the swing structure 70 an assembly of a respective tower 10, 20, a respective swing arm 11, 21 and a respective parallel guide link systems 43, 45. Only one of said assemblies is described.

The first swinging arm 11 is at its first end 12 rotatable connected to the first tower 10. The carrier 30 is rotatable connected to the second end 13 of the first swinging arm 11. The carrier 30 is rotatable with respect to the first swinging arm 11 around the carrier rotation axis Cra. The carrier rotation axis Cra is adapted to stay parallel to the swinging axis Sa while the swinging arms 11, 21 rotate around the swinging axis Sa. Here, the carrier 30 has in use a centre of mass above the carrier rotation axis Cra. The carrier 30 is connected to the first tower 10 through the first parallel guide link systems 43 of the stability mechanism 40. Thus, the carrier 30 connects to the first tower 10 through the first swing arm 11 and the first parallel guide link system 43. The first swing arm 11 and the first parallel guide link system 43 work in parallel to connect the carrier 30 to the first tower 10. The carrier is rotatable with respect to the first swinging arm 11. However, the carrier 30 is fixedly connected with the first parallel guide link system 43 with respect to rotation around carrier rotation axis Cra.

The carrier 30 connects to the first tower 10 through the first swing arm 11 in order to transmit forces from the carrier 30 to the first tower 10. The carrier 30 connects to the first tower 10 through the first parallel guide link system 43 in order to impose the defined position to the carrier 30. The defined position is an angular position, wherein the carrier 30 is substantially horizontal as perceived by passengers.

Regarding the first parallel guide link system 43. As background, a parallel guide link system has two parallel link members that are at one end rotationally coupled to a reference. The other end of the two parallel link members is rotationally coupled to a so called crankshaft. The parallel guide link imposes a position to the crankshaft and that position is based or derived from the reference. Now turning to the amusement device 1. The first and second parallel guide link system 43 comprises two parallel link members 11, 41, thus the swing arm 11 forms one of the parallel link members. Further reference is made to the swing arm 11, and the parallel arm member 41. The swing arm 11, and the parallel arm member 41 have equal length, as is required for parallel guide link systems. It will be clear that length refers to spacing of centres of rotation. If required, one or both of the swing arm 11 and parallel arm member 41 are length adjustable to enable to accommodate manufacturing tolerances. The swing arm 11, and the parallel arm member 41 are freely rotatable coupled to the first tower 10. The first tower 10 is the reference for the first parallel guide system 43. The parallel arm member 41 is freely rotatable around a link member rotation axis Lma. The link member rotation axis Lma is eccentric with respect to the horizontal swinging axis Sa. Here, the parallel arm member 41 is connected to the first tower 10 through a rotation mechanism 44, here a slewing bearing 44. The slewing bearing 44 extends around the swinging axis Sa. The first parallel guide link systems 43 comprises a crankshaft 46. The crankshaft is fixedly connected to the carrier 30 to impose a position to the carrier 30.

As explained, each of the respective first and second tower 10, 20 has a respective first or second parallel guide link systems 43, 45 associated therewith. In other words, the first parallel guide link systems 43 connects to the first tower 10 and the and second parallel guide link systems 45 connects to the second tower 20. The positions of the first and second parallel guide link systems 43, 45 differ when projected in a plane perpendicular to the swinging axis Sa. In this shown configuration, the positions of the first and second parallel guide link systems 43, 45 differ in that respective crankshafts 46, 47 make an angle $\alpha$ of about 90°.

The amusement device further comprising a counterweight 50. The counterweight compensates the weight of the carrier 30 and passengers. A counterweight 50 is attached to the first swinging arm 11 and the second swinging arm 21.

The amusement device further comprising a horizontal member 60. The horizontal member 60 is oriented along the swinging axis Sa. The horizontal member 60 connects the first ends 12, 22 of the first and second swinging arms 11, 21.

FIG. 2 shows a side view of the amusement device 1 of FIG. 1 in a second position. In this second position, the first swinging arm 11 extends horizontal. As shown, the carrier 30 maintains the defined angular position, which is a horizontal position. The amusement device 1 comprises a first tower having a top section 80. The first and second tower 10, 20 are placed on a transportable unit 2 like a trailer or a container.

Figure 3:
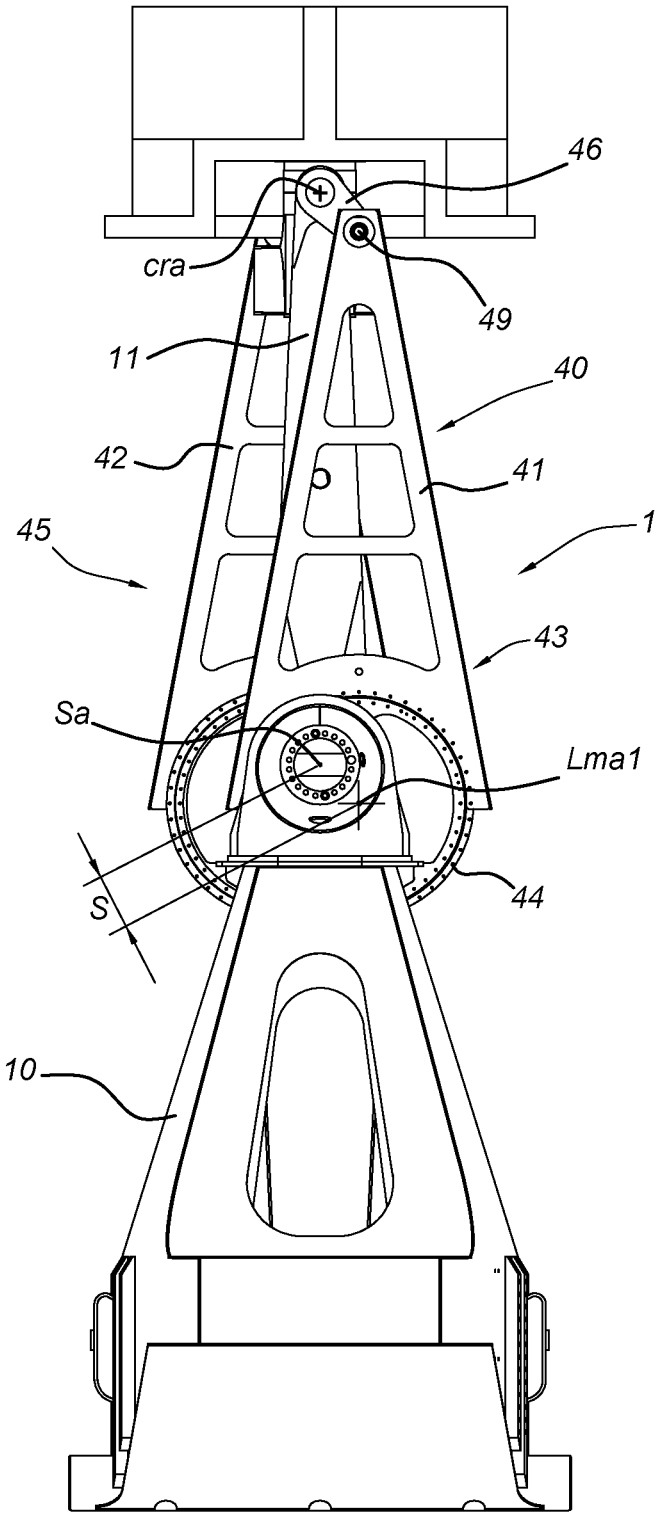
FIG. 3 shows a side view of the amusement device of FIG. 1 in a third position.
Figure 8A:
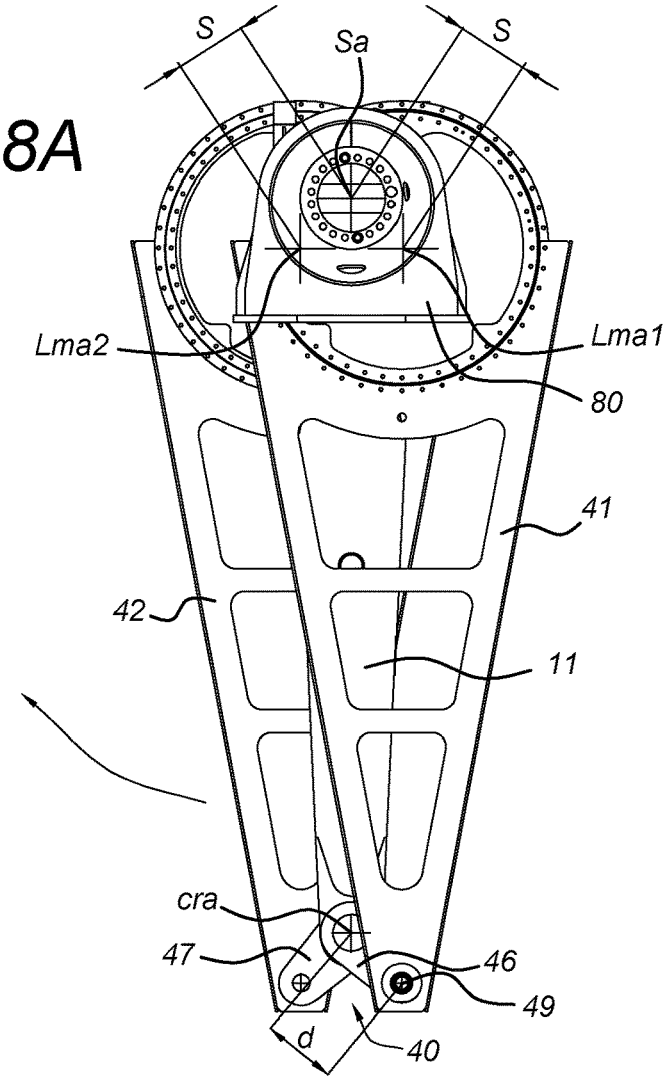
FIG. 8A-E shows the stability mechanism of the amusement device of FIG. 1 in different subsequent positions.
Figure 8B:
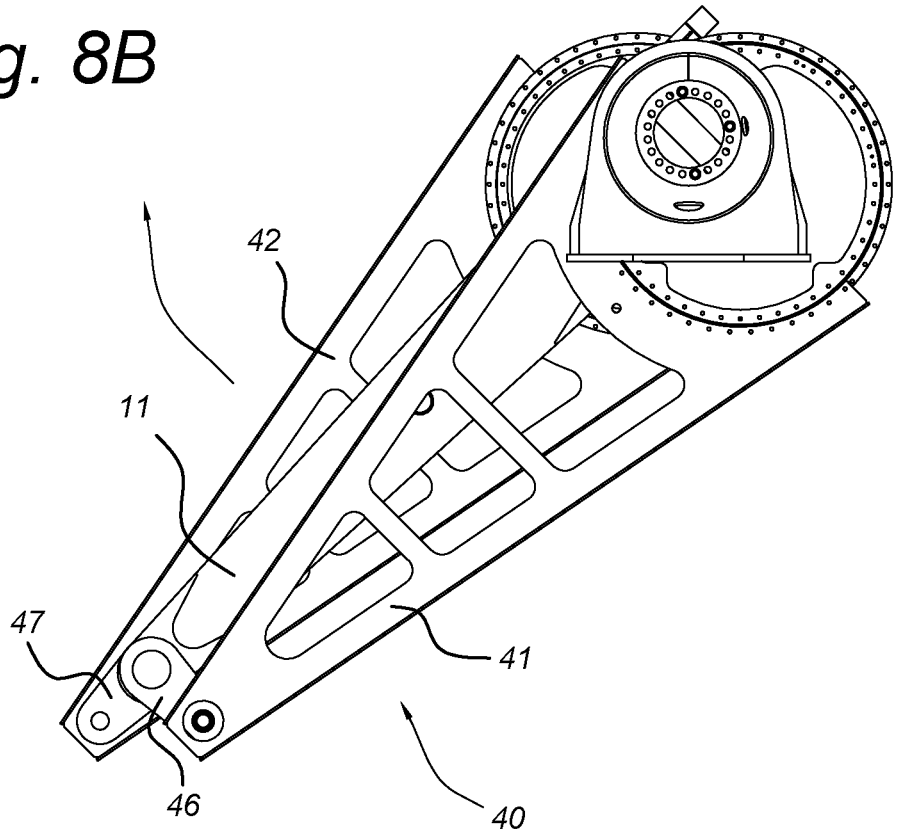
Figure 8C:
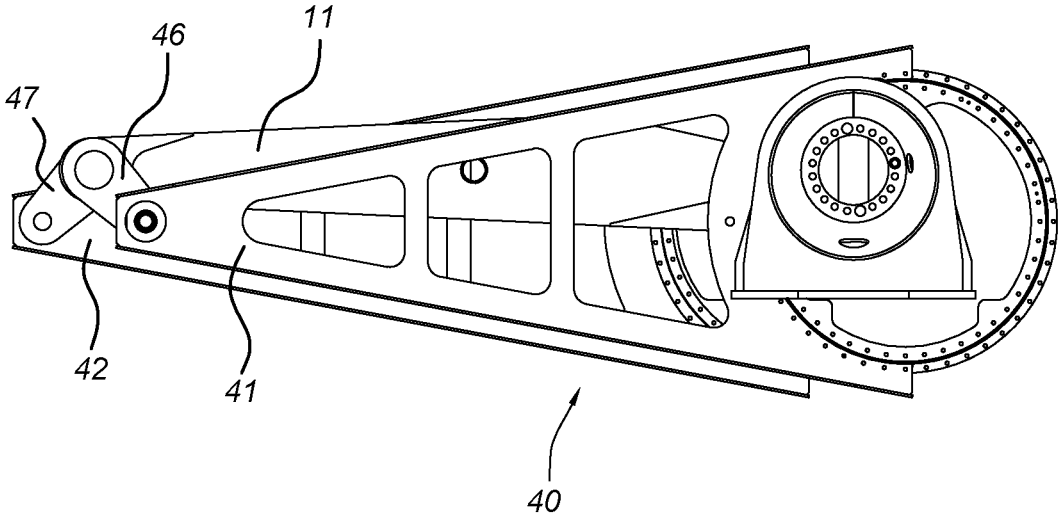
Figure 8D:
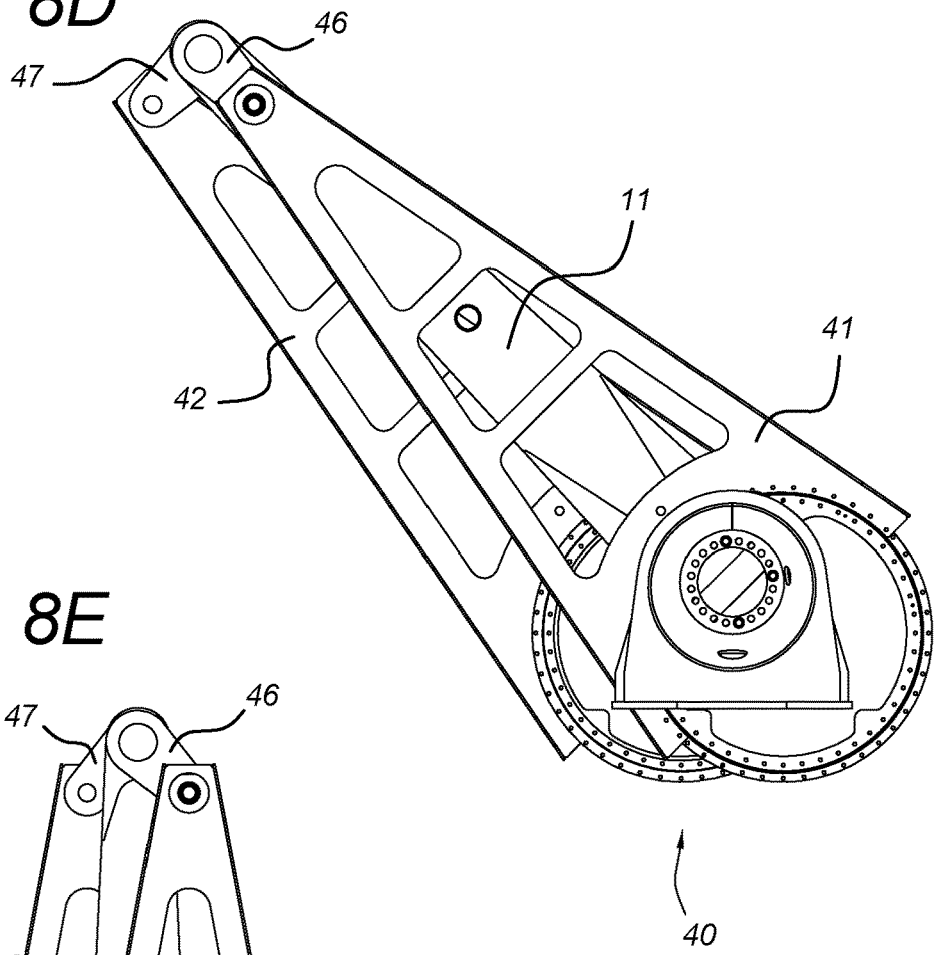
Figure 8E:
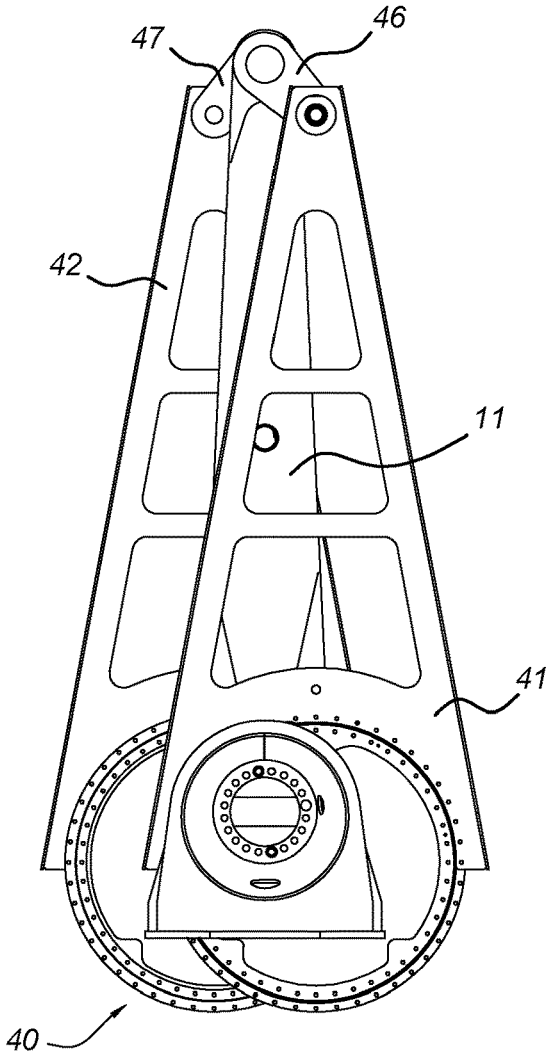

FIG. 3 shows a side view of the amusement device 1 of FIG. 1 in a third position. In this third position, the first swinging arm 11 extends vertical. As shown, the carrier 30 maintains the defined angular position, which is a horizontal position. The first and second parallel guide link systems 43, 45 are arranged in differing positions as can be best seen referring to the parallel link members 41, 42. The first and second parallel guide link systems 43, 45 are arranged in differing positions such that that respective crankshafts 46, 47 make an angle α of about 90° which is best seen in FIG. 8A.

Figure 4:
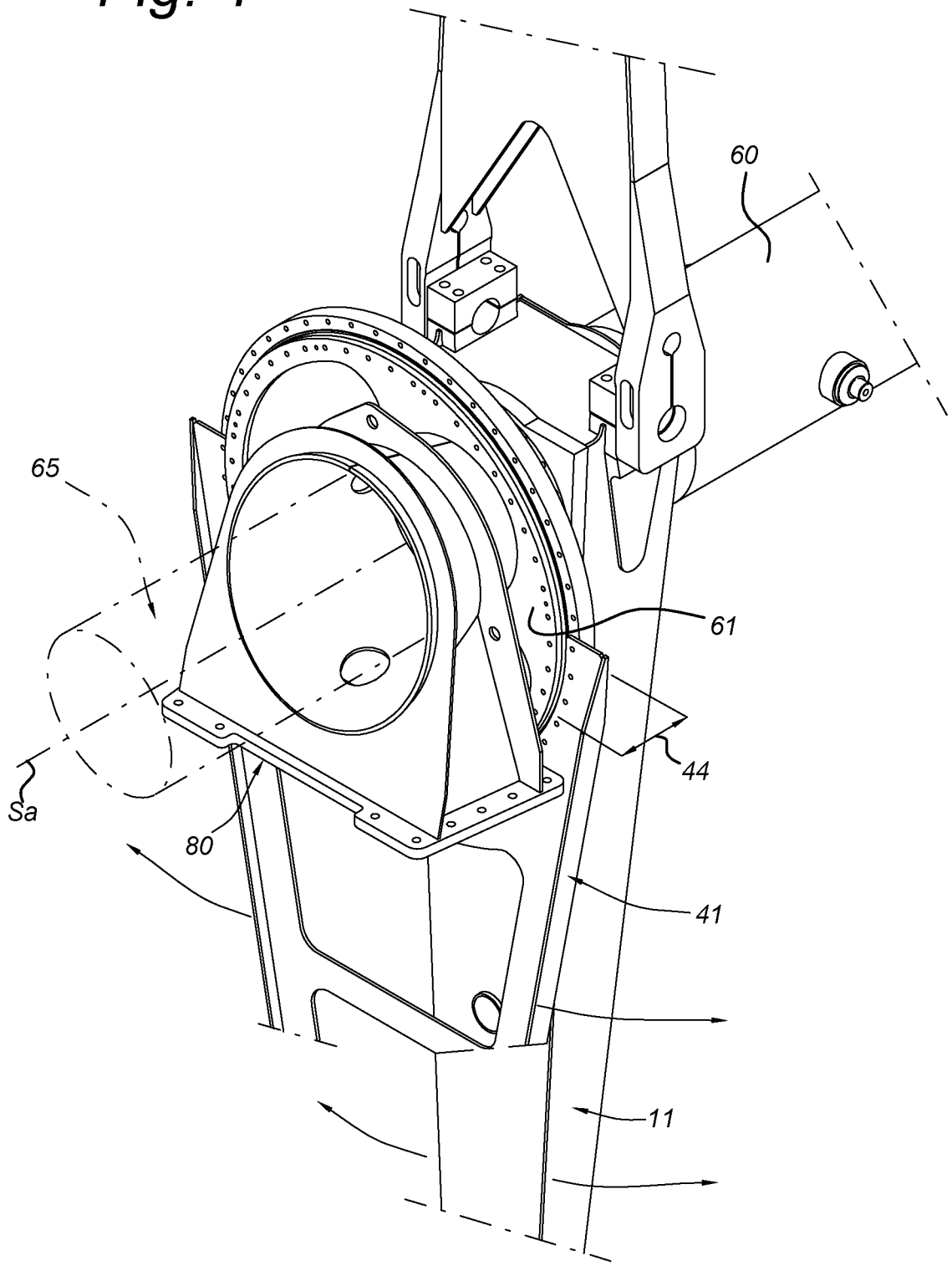
FIG. 4 shows a perspective view of a detail of the amusement device of FIG. 1.

FIG. 4 shows a perspective view of a detail of the amusement device of FIG. 1. The top section 80 of the first tower 10 is shown. The swing arm 11 and the parallel arm member 41 are partly shown. A mounting plate 61 is fixedly mounted with the top section 80. The mounting plate 61 and the top section 80 can be an assembly of parts or be of one part. The mounting plate is described with reference to FIG. 6. A powered drive 65 is shown that is coupled to the first swinging arm 11 to swing the carrier 30 around the swinging axis Sa. The rotation mechanism 44 is a 360° type of rotation mechanism. The rotation mechanism 44 may comprise a plain bearing, a sliding contact bearing, a ring bearing, a ball bearing or any other suitable means. Here, the rotation mechanism is a slewing bearing. The rotation mechanism 44, has a centre of rotation Lma1 in FIG. 6B that is offset with respect to the swinging axis Sa. Here, the centre of rotation Lma1 is offset with respect to the swinging axis Sa by a spacing s which is better shown in FIG. 6B. The axis of rotation of the rotation mechanism 44 is parallel with respect to the swinging axis Sa.

Figure 5:
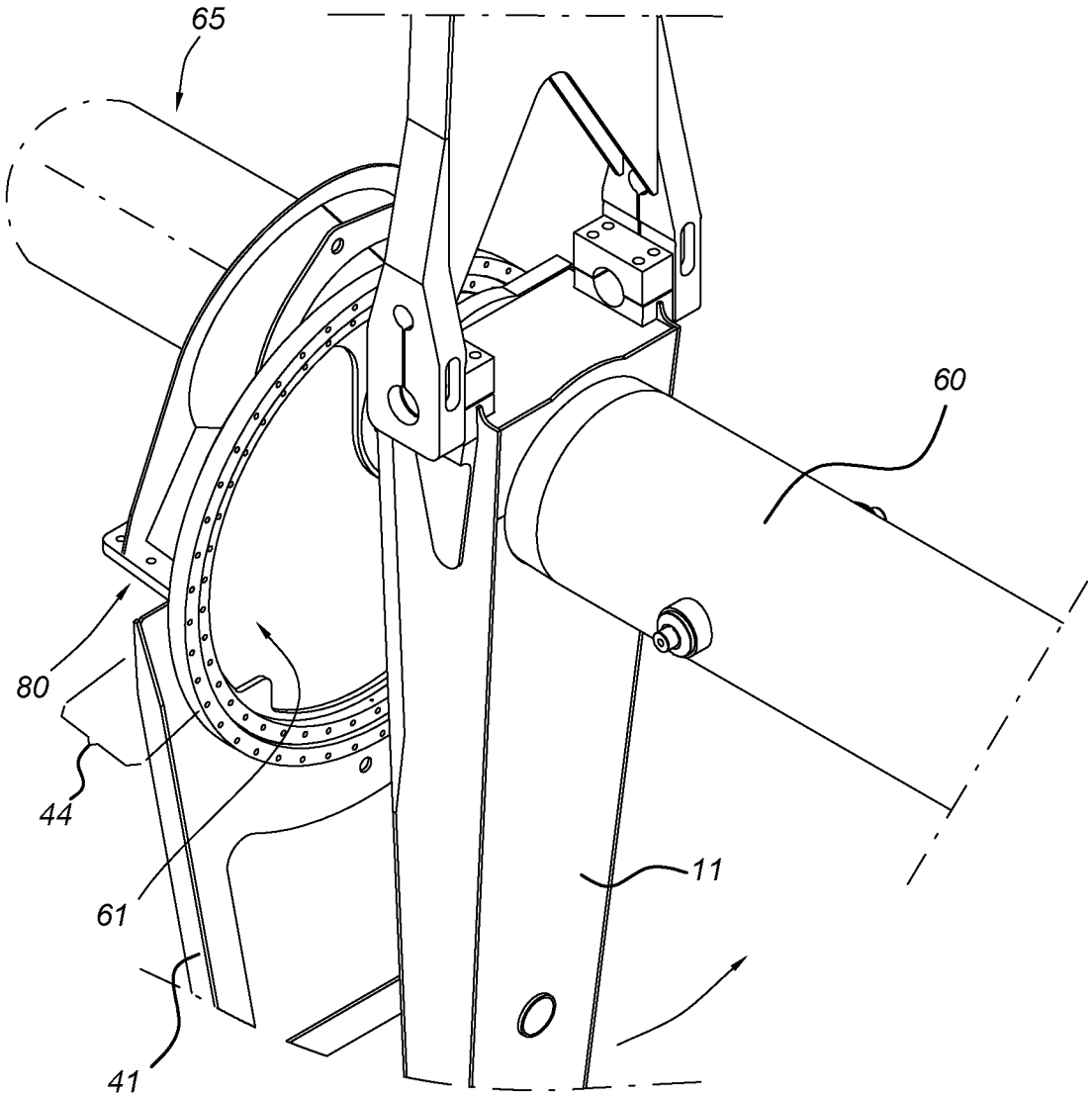
FIG. 5 shows a different perspective view of the detail of FIG. 4.

FIG. 5 shows a different perspective view of the detail of FIG. 4.

Figure 6A:
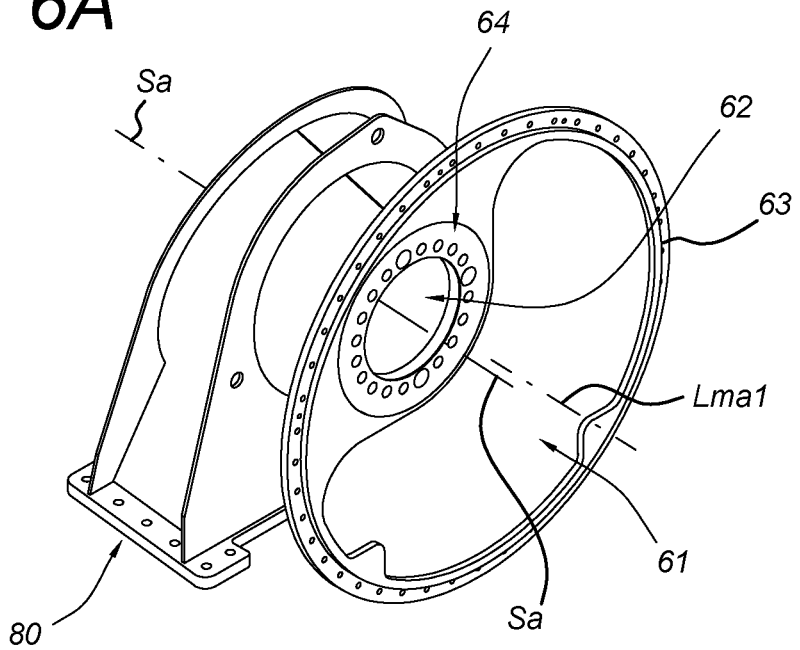
FIG. 6A shows a perspective view of another detail of the amusement device of FIG. 1.
Figure 6B:
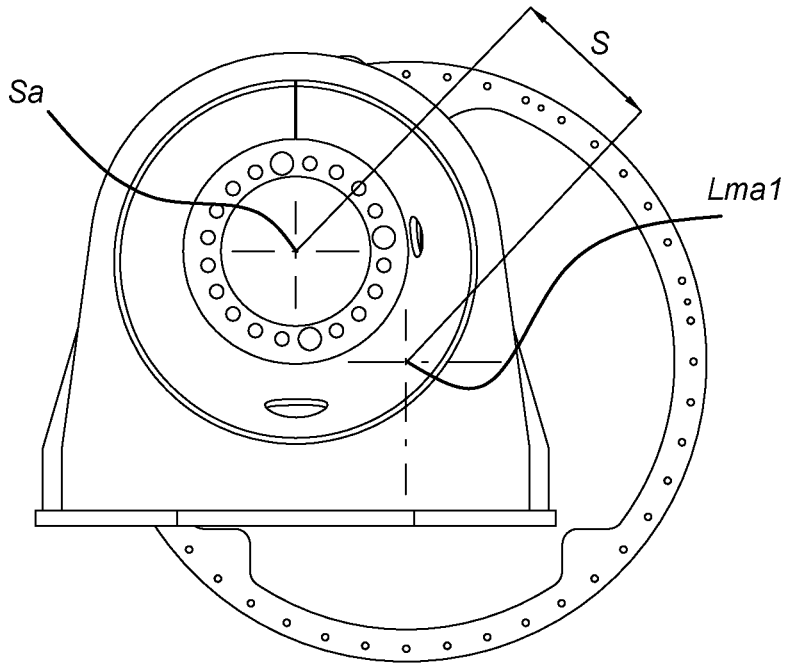
FIG. 6B shows a front view of the detail of FIG. 6A.

FIG. 6A shows a perspective view of another detail of the amusement device of FIG. 1. The mounting plate 61 has a mounting seat 63 for connecting the slewing bearing 44 to the mounting plate 61. The mounting seat 63 extends at the outer circumference of the mounting plate 61. The mounting plate 61 has a further mounting seat 64 for rotatably connecting the first swing arm 11 to the mounting plate 61. As shown, the further mounting seat 64 is eccentric with respect to the mounting seat 63. Therefore, the swinging axis Sa and the link member axis Lma are offset over a spacing s. The mounting seat 63 extends around the further mounting seat 64. Both the first and second parallel guide link systems 43, 45 have a respective mounting plate 61. The respective mounting plates 61 have different orientations as can be seen in FIG. 3. Because of the different orientations of the respective mounting plates 61, the first and second parallel guide link systems 43, 45 are arranged in differing positions.

The spacing S is determined by the mounting plate 61. Thus the rotation mechanism 44 and the bearing (not shown) of the swinging axis Sa have the mounting plate 61 in common. This improves an accurate spacing S.

Figure 7:
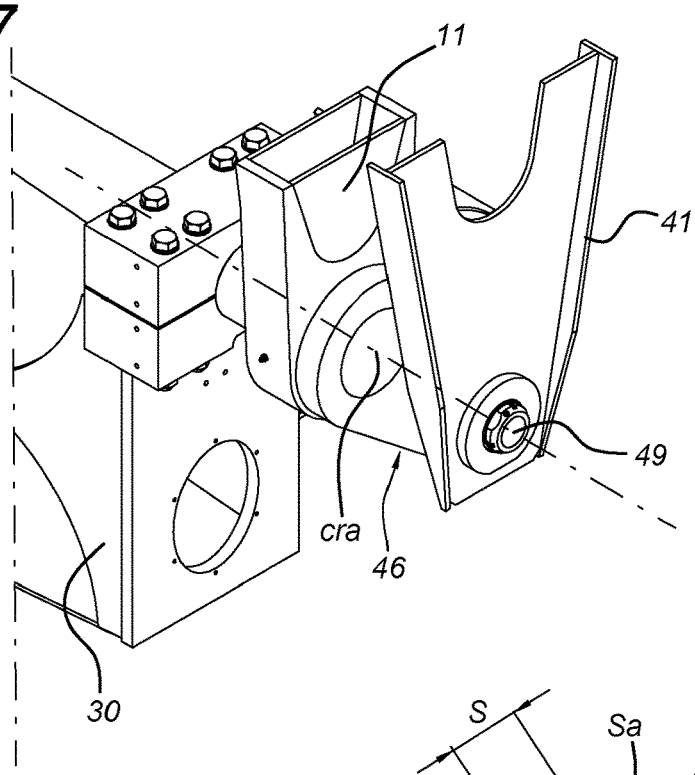
FIG. 7 shows a perspective view of another detail of the amusement device of FIG. 1.

FIG. 7 shows a perspective view of another detail of the amusement device of FIG. 1; The carrier 30, the swing arm 11 and the parallel arm member 41 are partly shown. The other ends of the swing arm 11 and the parallel arm member 41 are rotationally coupled to the crankshaft 46. The crankshaft 46 has a defined predetermined length, more precise the distance d between the two centres of rotation 48, 49 is predetermined. The distance d between the two centres 48, 49 of rotation is in accordance with the spacing s between the swinging axis Sa and the link member axis Lma as shown in FIG. 6. The distance d and the spacing s are equal. The crankshaft 46 is fixedly connected to the carrier 30 to impose an angular position to the carrier 30.

FIG. 8*a-e* shows the stability mechanism 40 of the amusement device 1 of FIG. 1 in different subsequent positions.

The stability mechanism 40 is configured to maintain the carrier 30 (not shown here) in an upright orientation, that is the defined position, while the carrier 30 rotates around the swinging axis Sa. In other words, the stability mechanism 40 imposes a defined angular position to the carrier 30 while rotating around the swing axis Sa. The stability mechanism 40 comprises first and second parallel guide link systems 43, 45. The first and second parallel guide link systems 43, 45 complement each other in stabilizing the carrier 30. The first and second parallel guide link systems 43, 45 are arranged in differing positions as can be best seen referring to the respective crankshafts 46, 47 in FIG. 8A-8E. The first and second parallel guide link systems 43, 45 are arranged in differing positions such that that respective crankshafts 46, 47 make an angle α of about 90°. The angle α of about 90° is constant during a full rotation of the first and second parallel guide link systems 43, 45 around the swinging axis Sa. FIG. 8A to 8E show 5 discrete subsequent positions of a half rotation of the first and second parallel guide link systems 43, 45 around the swinging axis Sa.

The first and second parallel guide link systems 43, 45 are arranged in differing positions as is also clear from the arrangement of the swinging axis Sa and respective link member axis Lma1, Lma2 of the first and second parallel guide link systems 43, 45. As can be seen, the centre of rotation, or also link member axis Lma1, Lma2 is offset with respect to the swinging axis Sa by a spacing S which is better shown in FIG. 6. The axis of rotation of the rotation mechanism 44 is parallel with respect to the swinging axis Sa.

The present invention has been described above with reference to a number of exemplary embodiments as shown in the drawings. Modifications and alternative implementations of some parts or elements are possible, and are included in the scope of protection as defined in the appended claims.

The invention claimed is:

1. Amusement device comprising:

a first tower;

a first arm, extending between a first end and a second end, which is at its first end rotatably connected to the first tower for allowing rotation of at least 180°, wherein the first arm is configured to rotate around a swinging axis (Sa), defined by the first end of the first arm, a carrier, rotatably connected to the second end of the first arm and rotatable around a carrier rotation axis (Cra), a stability mechanism connecting the carrier with the first tower, wherein the stability mechanism is configured to maintain the carrier in an upright orientation while the first arm rotates around the swinging axis (Sa), wherein the stability mechanism comprises first and second parallel guide link systems, wherein at least one of the first and the second parallel guide link systems connect the carrier with the first tower, and wherein positions of the first and second parallel guide link systems differ when projected in a plane perpendicular to the swinging axis (Sa), such that the first and second parallel guide link systems are adapted to alternately stabilize the carrier when the swinging arm rotates around the swinging axis (Sa).

2. The amusement device according to claim 1, wherein each of the first and second parallel guide link systems comprises a crankshaft, and wherein positions of the first and second parallel guide link systems differ in that the respective crankshafts make an angle $\alpha$ of about 90° with each other.

3. The amusement device according to claim 2, wherein the respective crankshafts of the first and second parallel guide link systems are fixedly connected to the carrier.

4. Amusement device according to claim 1 and further comprising:

a second tower, spaced apart from the first tower;

a second arm, extending between a first end and a second end, which is at its first end rotatably connected to the second tower, wherein the first and second arms are configured to together rotate around the horizontal swinging axis (Sa), defined by the first ends of the first and second arms, wherein the carrier is rotatably connected to the second ends of the first and second arms, and rotatable around the carrier rotation axis (Cra).

5. The amusement device according to claim 4, wherein the first parallel guide link system connects to the first tower the second parallel guide link system connects to the second tower.

6. The amusement device according to claim 4, wherein the first and second arms are adapted to rotate over 360 degrees around the swinging axis (Sa).

7. The amusement device according to claim 4, wherein the carrier rotation axis (Cra) is adapted to stay parallel to the swinging axis (Sa) while the first and second arms rotate around the swinging axis (Sa).

8. The amusement device according to claim 4, further comprising at least one counterweight, attached to the first arm and/or the second arm.

9. The amusement device according to claim 4, further comprising an horizontal member, oriented along the swinging axis (Sa) and connecting the first ends of the first and second arms.

10. The amusement device according to claim 4, wherein the first and second towers are supported by a transportable unit.

11. The amusement device according to claim 1, wherein at least one of the first and second parallel guide link systems comprises a parallel arm member that is freely rotatable around a parallel arm member rotation axis (Lma1, Lma2) eccentric with respect to the swinging axis (Sa), and wherein the parallel arm member is connected to the first or second tower through a rotation mechanism that extends around the swinging axis (Sa).

12. The amusement device according to claim 1, wherein the carrier has in use a centre of mass above the carrier rotation axis (Cra).

* * * * *